US006175959B1

(12) United States Patent
Somers

(10) Patent No.: US 6,175,959 B1
(45) Date of Patent: Jan. 23, 2001

(54) WRAP-AROUND AND WATERPROOF SEAT APPAREL FOR OUTDOOR APPLICATIONS

(76) Inventor: Jeffrey H Somers, 28953 Dixboro Rd., South Lyon, MI (US) 48178

( * ) Notice: Under 35 U.S.C. 154(b), the term of this patent shall be extended for 0 days.

(21) Appl. No.: 09/503,311

(22) Filed: Feb. 14, 2000

(51) Int. Cl.[7] ..... A41D 13/00
(52) U.S. Cl. ..... 2/46; 2/69; 2/455
(58) Field of Search ..... 2/46, 69, 227, 2/228, 238, 232, 48, 44, 24, 1, 456, 455, 466, 267

(56) References Cited

U.S. PATENT DOCUMENTS

| | | | | |
|---|---|---|---|---|
| D. 392,089 | | 3/1998 | Draper . | |
| D. 415,335 | | 10/1999 | Castiglione . | |
| 4,689,829 | | 9/1987 | Kaplan . | |
| 4,735,423 | * | 4/1988 | Foss | 2/46 |
| 4,837,859 | * | 6/1989 | Hamberg | 2/46 |
| 4,993,077 | | 2/1991 | Robison . | |
| 5,003,634 | | 4/1991 | Brinkman . | |
| 5,068,920 | | 12/1991 | Bray . | |
| 5,241,706 | * | 9/1993 | Netz | 2/46 |
| 5,282,277 | | 2/1994 | Onozawa . | |
| 5,359,731 | | 11/1994 | Cavalier . | |
| 5,386,603 | | 2/1995 | Drust . | |
| 5,414,881 | | 5/1995 | Terrazas . | |
| 5,625,895 | | 5/1997 | Sovereign . | |
| 5,740,566 | | 4/1998 | Stacy . | |
| 5,740,567 | | 4/1998 | Mitchell . | |
| 5,787,502 | | 8/1998 | Middleton . | |
| 5,871,132 | | 2/1999 | Hargreaves . | |
| 5,896,582 | | 4/1999 | Baacke et al. . | |

* cited by examiner

*Primary Examiner*—Gloria M. Hale
(74) *Attorney, Agent, or Firm*—Gifford, Krass, Groh, Sprinkle, Anderson & Citkowski, P.C.

(57) ABSTRACT

A wrap around article capable of being donned by a user engaged in outdoor pursuits including an ergonomically configured main body having top, side and bottom edges and which is constructed of a durable and waterproof material such as neoprene with an interior cushioning foam material. The bottom edge of the article is further defined by first and second downwardly extending legging portions which are separated by a central arcuately recessed and split crotch portion. A main belt is secured in proximity to the top edge of the article and first and second secondary straps are secured, respectively, to locations proximate the bottom edges of each of the first and second legging portions. Both the main belt and secondary straps each further include interengaging members typically provided as snap fit members forming terminating portions of an adjustable main belt and releasably interengaging Velcro® attachment portions for comfortably securing the article to the buttocks and upper legs of the user. The article is configured so that it conforms comfortably to the buttocks and about the upper legs of the user while providing the user a significant degree of movability.

7 Claims, 2 Drawing Sheets

WRAP-AROUND AND WATERPROOF SEAT APPAREL FOR OUTDOOR APPLICATIONS

BACKGROUND OF THE INVENTION

1. Field of the Invention

The present invention relates generally to seat or pant insulating and waterproofing devices and, more particularly, to a convenient wrap-around and waterproof article of apparel which can be quickly applied over the user's conventional outdoor clothing and which provides a measured degree of both waterproof resistance when the user is in a seated position during the outdoor activity, as well as a degree of insulating warmth.

2. Description of the Prior Art

Various types of insulating and, to some extent, waterproofing, seat materials are known in the art and for use in outdoor activities. A first example of such a device is set forth in U.S. Pat. No. 5,625,895, issued to Sovereign, and which discloses a garment for protecting the buttocks of a wearer when seated.

Sovereign includes a waist band with a rectangular pad depending downwardly from a rear of the waist band and having a width which extends around the rear of the wearer and downwardly beyond the wearer's crotch. A utility pocket is provided on an inner or front surface of the pad and so that the pocket is arranged forwardly and between the legs of the user when the user is seated. On the outside of the pad is provided a transparent plastic cover defining a pocket for receiving printed information such as a sports logo and the pocket is closable by pulling the waist band around the waist of the user.

While providing an interesting disclosure, it is noted that the device of Sovereign likely has certain limitations to the size of individual to which it can be applied by virtue of its construction. Furthermore, the incorporation of multiple layers of material, including the inner fleece layer, the layer of foam material, and the outer waterproof layer, tend to add bulkiness to the article. It has been also found that, once the outer waterproof layer inevitably becomes ripped, torn or snagged due to persistent outdoor use, the inner layers of a device such as Sovereign will quickly become waterlogged and compromised, thus rendering them ineffective for their intended tasks.

U.S. Pat. No. 5,003,634, issued to Brinkman, teaches a belt type garment with foldable seat cover and having straps projecting from opposing ends of a pouch secured about a user's waist. An elongate opening formed in the pouch is positioned above the user's seat and is releasably closed by two separate (inner and outer) zippers. An elongate panel or sheet of flexible, waterproof material is secured at one end of one edge of the pouch opening to extend downwardly out of one (outer) zipper into an operative position beneath one's seat. The panel or sheet may then be secured in place by two other straps which fasten around the legs of the user. The inner zipper may be closed to retain personal items in the pouch. When not in use, the waterproof panel is rolled up and stored in the pouch.

While providing an effective article, Brinkman includes a substantially rectangular and uniform cover section with only a first and second strap extending from opposite edges of the cover section. The further fact that the straps extend from proximately the outer opposite edges, rather than from more central locations of the panel of material, causes to provide a lesser degree of support to the user. Accordingly, the device of Brinkman tends to become very cumbersome and bulky when worn by a user, in that it restricts the freedom of motion of the user's legs and due to the tendency of the user to want to be able to move about with the upper portion of one leg in varying differing positions relative to the other leg, such usually being the case when climbing or scaling upon outdoor obstacles (trees, shrubs, hills, etc.). Accordingly, Brinkman would in reality be fairly limiting in actual applications.

SUMMARY OF THE PRESENT INVENTION

The present invention is a wrap around article capable of being donned by a user engaged in outdoor pursuits and including an ergonomically configured main body having top, side and bottom edges and which is constructed of a durable and waterproof material such as neoprene with an interior cushioning foam material. The bottom edge of the article is further defined, in a first preferred embodiment, by first and second downwardly extending legging portions and which are separated by a central arcuately recessed and split crotch portion.

A main belt is secured in proximity to the top edge of the article and first and second secondary straps are secured, respectively, to locations proximate the bottom edges of each of the first and second legging portions. Both the main belt and secondary straps each further include interengaging means, such typically provided as snap fit members forming terminating portions of an adjustable main belt and releasably interengaging Velcro® attachment portions for comfortably securing the article to the buttocks and upper legs of the user. Additional features of the instant invention include the modification and removal of the lower split crotch recess and the employment of rivets to reinforce the integrity of the article.

BRIEF DESCRIPTION OF THE DRAWINGS

Reference will now be made to the attached drawings, when read in combination with the following specification, wherein like reference numerals refer to like parts throughout the several views, and in which.

DETAILED DESCRIPTION OF THE PREFERRED EMBODIMENTS

Figure 1:
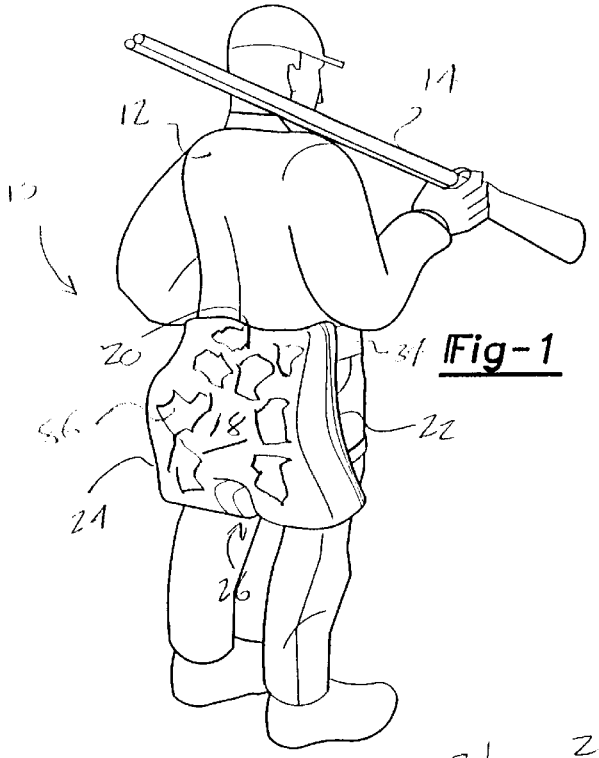
FIG. 1 is a perspective environmental view of the wrap-around and waterproof seat apparel article according to a first preferred embodiment and showing it being worn by a user engaged in an outdoor activity.

Referring now to FIG. 1, a perspective environmental view is illustrated at 10 of the wrap-around and waterproof seat apparel article according to a first preferred embodiment and showing it being worn by a user 12 engaged in an outdoor activity such as hunting which is implied by the fact that the user carries a firearm 14. As will be further described in additional detail, it is understood that the wrap around article of the present invention can be employed in many and numerous outdoor applications, such as in hunting, fishing, skiing and in addition to outdoor spectator sports and the like. As will also be further described in additional detail, the purpose of the wrap around article of the instant invention is to provide the wearer with a quickly securable garment over the user's existing outerwear and which enables the user to primarily acquire a degree of water-resistance to the existing outerwear clothing and, furthermore a secondary and additional degree of thermally insulating protection afforded by the wrap around article.

Figure 2:
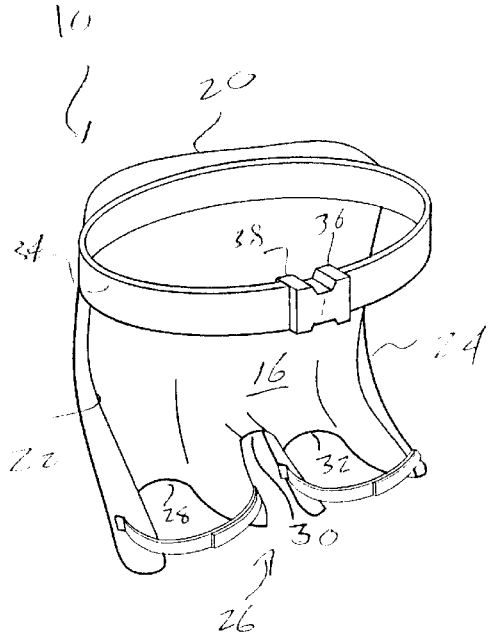
FIG. 2 is a further perspective view of the seat apparel article in a substantially 180° rotated position relative to FIG. 1 and further illustrating the main interengaging belt incorporated proximate to the upper edge of the article and combined with the first and second downwardly extending legging portions and the first and second secondary leg attachment portions.
Figure 3:
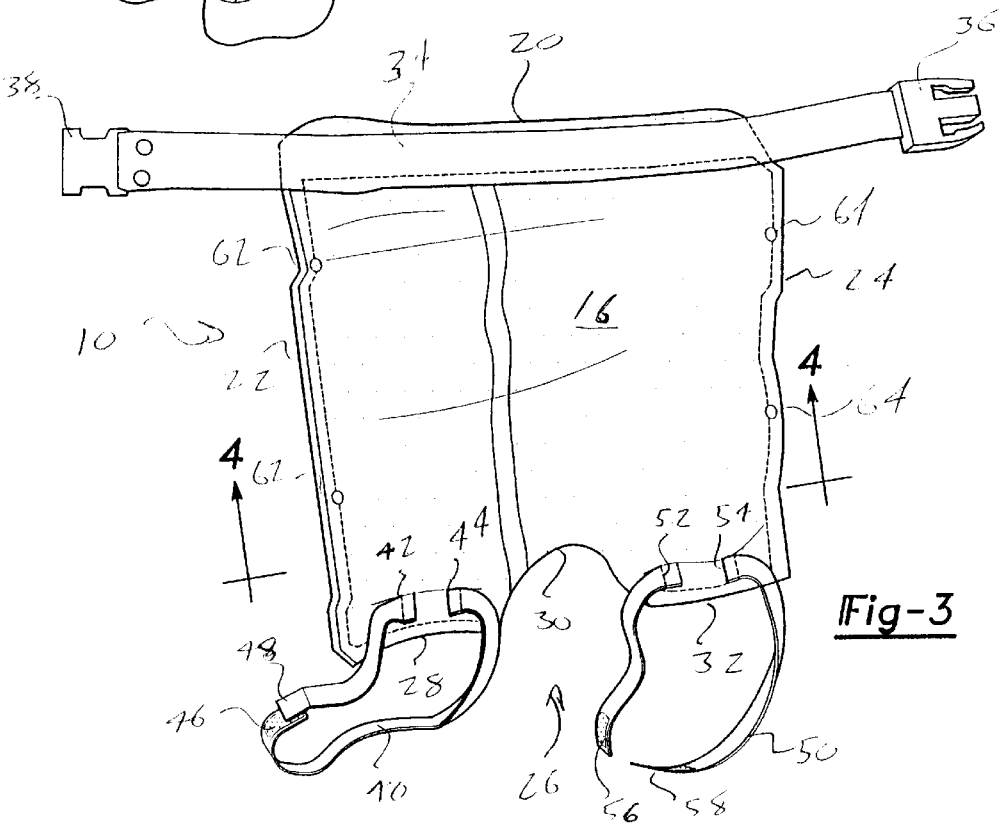
FIG. 3 is a disengaged plan view of the seat apparel article and illustrating its inwardly facing surfaces.

Referring to FIGS. 2 and 3, further perspective and plan views are illustrated, respectively, of the seat apparel article 10 in substantially 180° rotated positions relative to the perspective of FIG. 1 and to reveal the inward surfaces of the article 10. In the preferred embodiment, the article 10 is constructed of a substantially and ergonomically configured main body covering a given surface area and including inner 16 and outer 18 facing surfaces. The article 10 further includes a top edge 20, a first extending side edge 22, a second extending side edge 24, and a generally bottom extending edge 26. The bottom extending edge is further defined as including a first downwardly extending legging portion 28, a central arcuately recessed and split crotch portion 30 and a second downwardly extending legging portion 32. The main body portion, as evident from FIGS. 1–3 taken in combination, is also inwardly and arcuately angled along the first and second extending side edges 22 and 24, as well as the downwardly extending legging portions 28 and 32. The purpose for this is to assist in the ergonomic conforming of the article 10 to the user's buttocks and upper legs, as is shown in FIG. 1, and so that the article can be comfortably worn during any outdoor activity.

A main interengaging belt 34 is incorporated proximate to the upper edge 20 of the article and, in the primary illustrated variation, is sewn against the inner 16 facing surface and continuously extends from the opposite edges 22 and 24. The main belt 34 terminates at one end in a first releasably interlocking portion 36 and at the other end in a second interengaging and releasably interlocking portion 38. The interlocking portions 36 and 38 are by themselves fairly well known in the art and typically consist of snap connectors or the like for quickly and effectively securing and releasing the belt. The belt may further be adjustable, as is well known in the art, and can be constructed of a nylon material.

Combined with the first 28 and second 32 downwardly extending legging portions are first and second secondary leg attachment portions as will now be described. A first strap 40 is received through first and second spaced apart slits 42 and 44 formed within the first leg attachment portion 28 and likewise terminates at first and second releasably engageable portions 46 and 48, these being such as are commercially known as Velcro® attachment portions. A second strap 50 is received through first and second spaced apart slits 52 and 54 formed within the second leg attachment portion 30 and likewise terminates at first and second releasably engageable portions 56 and 58, these again being Velcro® attachment portions or the like.

The straps 40 and 50 are illustrated as each being constructed of one continuous extending member, however it is understood that, rather than including pairs of spaced apart slits, the straps 40 and 50 could each be reconfigured as first and second spaced apart pairs of straps (not shown) and which are easily envisioned as being sewn against the interior facing surface 16 of the legging portions 28 and 32, not dissimilar to the manner of securing the main belt 34. As is further shown in FIG. 1, the main belt 34 and second straps 40 and 50 are engaged about the waist and upper leg portions, respectively, of the wearer so that the article is firmly fixed in place. The advantage, as previously stated, of the wearable article 10 is that it is capable of being quickly donned or removed and, combined with its ergonomic configuration, provides a fair degree of comfort and adaptability to user's of differing size.

Figure 4:
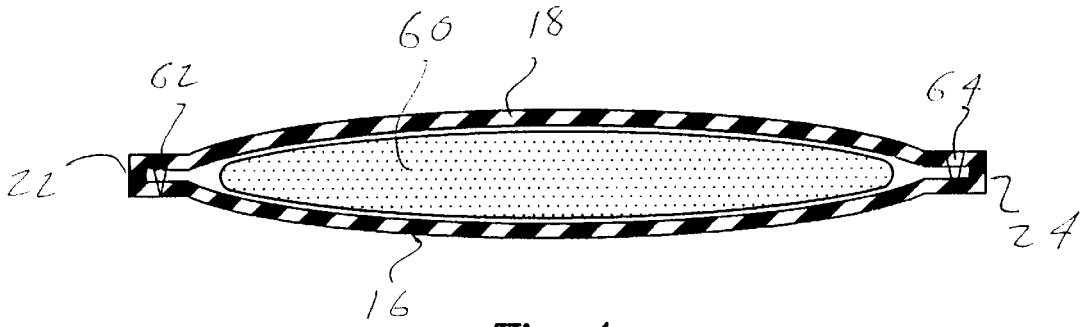
FIG. 4 is a cutaway view taken along line 3—3 of FIG. 3 and further illustrating the outer neoprene layer which surrounds an interior layer of foamable material according to a preferred variant of the present invention.

Referring to the cutaway view of FIG. 4, in combination with the plan view of FIG. 3 previously described FIG. 4, the material content of the article 10 according to a preferred variant is now described. According to the preferred embodiment, the inner 16 and outer 18 facing surfaces of the article 10 are each constructed of a layer of a neoprene or like material and which provides the requisite qualities of water resistance and, to a lesser extent, thermal protection against the outside elements. It is also well understood that the outer layers of neoprene can be substituted by other types of materials, without departing from the scope of the invention, and in which such other materials exhibit the necessary properties of water resistance and, in some instances, additional thermal protection. It is also well known that the existing outerwear itself achieves greater levels of thermal insulating ability by maintain dryness, therefore the present invention achieves both objectives by primarily maintaining the dryness of clothing it is wrapped around by the user.

Surrounded by the outer layers of neoprene is an interior layer of a foamable material 60 according to a preferred variant of the present invention. The foamable layer of material 60 is also useful in providing a degree of cushioning and seating support of the user as well as some additional thermal insulation. The advantages of utilizing an expanded plasticized or foamable type material as an inner layer includes the ability to construct the article 10 at a relatively lower cost and with less fabricating time, as well as the intrinsic characteristic of such materials to also repel water if by chance it permeates beyond the outer neoprene layers. This is particularly in contrast to the utilization of the fleece layer in the Sovereign disclosure and wherein such an application may cause increased water retention. Rivets 62 and 64 are provided at spaced locations and proximate the first and second side edges 22 and 24, respectively, of the article 10. The rivets provide the function of reinforcing the stitched or adhesive securement between the outer neoprene or other waterproofing layers and the central foamable material, such manner of securing the layers together being alternatively or cumulatively available.

Figure 5:
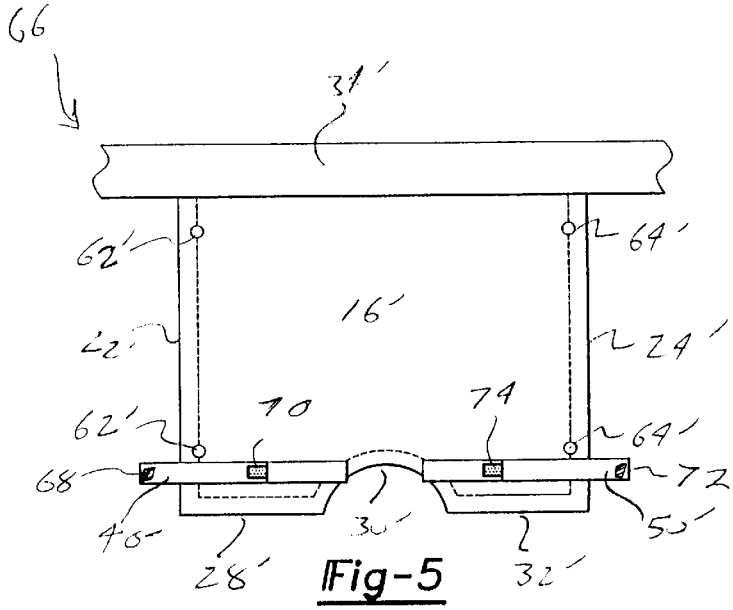
FIG. 5 is a view of a view of a wrap-around and waterproof seat apparel article according to a further variant of the first preferred embodiment and again illustrating the lower arcuate recess for defining a crotch portion and assisting in the ambulatory movement of a wearer.

Referring now to FIG. 5, a view is shown, at 66, of the wrap-around and waterproof seat apparel article according to a further variant of the first preferred embodiment. The variant 66 is similar in many regards to that illustrated in the primary first embodiment of FIGS. 1–4, and again includes the main body covering a given surface area and including inner outer facing surfaces, only an inner surface 16' being illustrated. The article 66 according to the further variant also top edge to which a belt 34' is secured, first extending side edge 22', second extending side edge 24', and generally bottom extending edge including first downwardly extending legging portion 28', central arcuately recessed and split crotch portion 30' and second downwardly extending legging portion 32'. Rivets 62' and 64' are again illustrated at spaced locations proximate the first and second extending side edges 22' and 24' and again for holding in place the multi-layer construction of the article.

The variant of the wrap around article 66 of FIG. 5 differs from the primary embodiment 10 primarily in that the shaping of the downwardly extending legging portions 28' and 32' are less pronounced. Also, the straps 40' and 50' are shaped somewhat differently, with the strap 40' including a 10 first interengaging portion 68 at an outer end and a second interengaging 70 at an intermediate location and the strap 50' likewise including a first interengaging portion 72 at an outer end and a second interengaging portion 74 at an intermediate location. It is also understood that the straps 40' and 50', as with the straps 40 and 50 of the primary embodiment, may be flexible in an axial direction to assist in engaging about varying circumferences of the user's upper leg. Again illustrated in FIG. 5 is the lower arcuate recess defining a crotch portion 30' and assisting the wearer in ambulatory movement.

Figure 6:
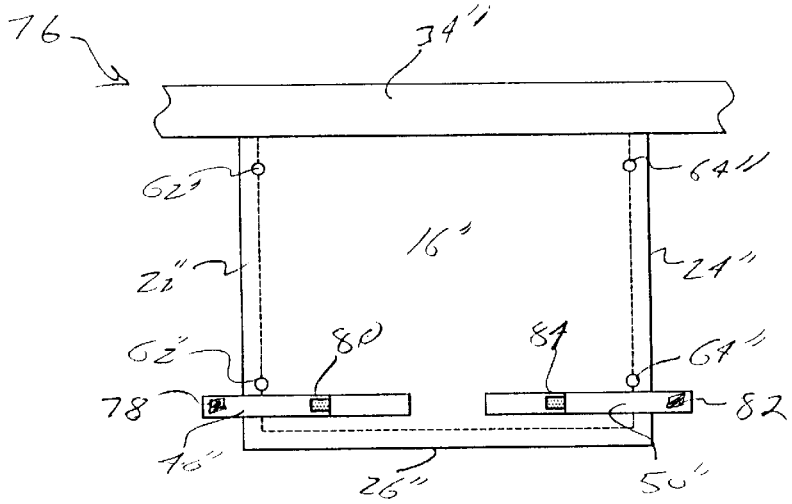
FIG. 6 is a view of a wrap-around and waterproof seat apparel article according to a further preferred embodiment and illustrating the removal of the split crotch portion, in combination.

Referring finally to FIG. 6, a view is shown, at 76, of the wrap-around and waterproof seat apparel article according to a further preferred embodiment and in which the split crotch portion has been removed from bottom extending edge 26". As with the variant 66 of FIG. 5, the article 76 is similar in many regards to that previously illustrated and once again includes the main body covering a given surface area and including inner and outer facing surfaces, only an inner surface 16" being illustrated. The article 76 also illustrates the top edge to which belt 34" is secured, first extending side edge 22", second extending side edge 24', and generally bottom extending edge 26. Rivets 62" and 64" are again illustrated at spaced locations proximate the first and second extending side edges 22" and 24" and again for holding in place the multi-layer construction of the article.

As with the variant 66 of FIG. 5, the straps 40" and 50" in FIG. 6 are shaped somewhat differently, with the strap 40" again including a first interengaging portion 78 at an outer end and a second interengaging portion 80 at an intermediate location and the strap 50" likewise including a first interengaging portion 82 at an outer end and a second interengaging portion 84 at an intermediate location. It is again understood that the straps 40" and 50 may be flexible in an axial direction to assist in engaging about varying circumferences of the user's upper leg.

Having described my invention, it will become apparent that it discloses a novel and useful wrap around article for numerous outdoor applications. Additional features include the ability to place numerous different types of colors and color schemes onto the exteriorly facing surfaces of the article and such as forest, snow or desert camouflage patterns (see at 86 in FIG. 1) for hunting, as well as any other solid colors or patterns corresponding to team logos. The wrap around article further provides many varied outdoor uses in which it is desirous to keep out exterior moisture and to maintain the dryness of the user's pants. Additional preferred embodiments will become apparent to those skilled in the art to which it pertains and without deviating from the scope of the appended claims.

I claim:

1. A wrap around article capable of being worn against the buttocks and upper legs of a user, said article comprising:

a main body extending over a given surface area and including a top edge, a first side edge, a second opposite side edge, and a generally extending bottom edge defining first and second legging portions, said main body further defining inner and outer facing surfaces, said inner and outer facing surface being constructed of a water repellant material and sandwiching therebetween an interior layer of a foamable and cushioning material;

a main belt secured in proximity to said top edge of said main body, said belt including first and second ends which display, respectively, first and second interlocking portions; and first and second straps extending proximately from first and second locations along said bottom edge and corresponding with said first and second legging portions, each of said straps including a pair of first and second extending portions which terminate in interengaging portions;

said article being positioned over the buttocks and adjoining upper legs of the user so that the main belt is adapted to being secured about the user's waist and said interengaging portions of said pairs of first and second straps are respectively secured about the upper legs, said first and second side edges and corresponding edges of said first and second legging portions being configured to wrap around the buttocks and legs of the user.

2. The wrap around article as described in claim 1, said generally extending bottom edge further comprising a centrally arrayed and arcuately recessed split crotch portion which separates said first and second legging portions.

3. The wrap around article as described in claim 2, further comprising said first and second side edges and corresponding edges of said first and second legging portions being configured to wrap around the buttocks and legs of the user.

4. The wrap around article as described in claim 2, said first and second straps being received through pairs of spaced apart slits formed in said first and second legging portions, respectively.

5. The wrap around article as described in claim 1, further comprising said inner and outer facing surfaces further being constructed of a neoprene material.

6. The wrap around article as described in claim 5, further comprising rivets being secured at spaced locations proximate said first and second side edges and through said article.

7. The wrap around article as described in claim 1, further comprising a color scheme or camouflage pattern placeable upon the outer facing surface of the article.

* * * * *